US011918166B2

(12) United States Patent
Martinez Mendez et al.

(10) Patent No.: US 11,918,166 B2
(45) Date of Patent: Mar. 5, 2024

(54) SYSTEMS FOR DETERGENT DISPENSING IN APPLIANCES

(71) Applicant: Haier US Appliance Solutions, Inc., Wilmington, DE (US)

(72) Inventors: Monica Martinez Mendez, Louisville, KY (US); Rose Marie Connelly, Louisville, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 0 days.

(21) Appl. No.: 17/699,452

(22) Filed: Mar. 21, 2022

(65) Prior Publication Data

US 2023/0292982 A1 Sep. 21, 2023

(51) Int. Cl.
*A47L 15/44* (2006.01)
*D06F 39/02* (2006.01)

(52) U.S. Cl.
CPC ..... *A47L 15/4463* (2013.01); *A47L 15/4436* (2013.01); *A47L 15/449* (2013.01); *D06F 39/026* (2013.01)

(58) Field of Classification Search
None
See application file for complete search history.

(56) References Cited

U.S. PATENT DOCUMENTS

| | | | | |
|---|---|---|---|---|
| 7,472,710 | B2 | 1/2009 | Jowett et al. | |
| 8,096,444 | B2 | 1/2012 | Ardern et al. | |
| 9,132,691 | B2 | 9/2015 | Hirsch et al. | |
| 9,717,393 | B2 | 8/2017 | Delgado et al. | |
| 2015/0359412 | A1* | 12/2015 | Delgado | A47L 15/4463 134/198 |
| 2016/0360789 | A1 | 12/2016 | Hawes et al. | |
| 2020/0039721 | A1 | 2/2020 | Curtin | |
| 2020/0397218 | A1 | 12/2020 | Fawaz et al. | |

FOREIGN PATENT DOCUMENTS

| | | | |
|---|---|---|---|
| CN | 211294056 | U | 8/2020 |
| EP | 1236430 | B1 | 12/2004 |
| EP | 1493375 | A1 | 1/2005 |

* cited by examiner

*Primary Examiner* — Levon J Shahinian
(74) *Attorney, Agent, or Firm* — Dority & Manning, P.A.

(57) ABSTRACT

A dispensing apparatus for an appliance includes a housing. The housing defines a loading chamber. A corkscrew coil is rotatably mounted in the loading chamber, and a motor is coupled to the corkscrew coil. Additionally, a chute defines an opening at an end of the corkscrew coil.

18 Claims, 4 Drawing Sheets

SYSTEMS FOR DETERGENT DISPENSING IN APPLIANCES

FIELD OF THE INVENTION

The present subject matter relates generally to systems for detergent dispensing in appliances.

BACKGROUND OF THE INVENTION

Dishwashers assist with cleaning of various items, including dishes, tableware, glassware, pots, pans, and utensils. During operation, a sump of the dishwasher is frequently filled with a wash fluid, such as a mix of water and detergent, which is pumped to one or more sprayers in order to clean items within the dishwasher with the cleaning mixture. The mixture can be recirculated to save water and energy. In a typical wash cycle, often there is a pre-rinse, which may or may not include detergent, and the water is then drained. This pre-rinse is followed by the main wash with fresh water and detergent. Once the main wash is finished, the water is drained, more water enters the tub, and the rinse portion of the wash cycle begins. After the rinse process finishes, the water is drained again, the dishes can be dried, and the wash cycle is complete. After each full cycle, the dishwashing detergent is re-filled.

Dishwashing detergent currently comes in three common forms: tablets; powder; and gel. Tablet detergent comes in the form of a small brick, and sometimes is half gel as well. Powder detergent is typically poured or scooped into a dispenser in the dishwasher, and gel detergent is also able to be poured into the dispenser. Each of the detergent types is able to be fabricated in the form of a detergent pod. As such, pod detergent may be any of the types of the detergent types, or any combination thereof, and the pod detergent may be replaced in the dispenser before each wash cycle.

BRIEF DESCRIPTION OF THE INVENTION

Aspects and advantages of the invention will be set forth in part in the following description, or may be apparent from the description, or may be learned through practice of the invention.

In one example embodiment, a dispensing apparatus for an appliance includes a housing that defines a loading chamber, a corkscrew coil rotatably mounted in the loading chamber of the housing and a motor coupled to the corkscrew coil.

In another example embodiment, a detergent pod dispensing apparatus for an appliance includes a housing that defines a chamber, and a door rotatably coupled to the housing. The door includes a radial gasket. The dispensing apparatus also includes a corkscrew coil disposed within the chamber. The corkscrew coil includes a first end portion and a second end portion, and a motor coupled to the corkscrew coil. The corkscrew coil is configured for receipt of a plurality of detergent pods between a flighting of the corkscrew coil.

In another example embodiment, an appliance includes a cabinet that defines a treatment chamber, and a detergent pod dispensing assembly. The detergent pod dispensing assembly includes a housing that defines a chamber, and a door rotatably coupled to the housing. The door includes a radial gasket. Also includes in the detergent pod dispensing assembly is a corkscrew coil disposed within the chamber. The corkscrew coil includes a first end portion and a second end portion, and a motor coupled to the corkscrew coil. The corkscrew coil is configured for receipt of a plurality of detergent pods between a flighting of the corkscrew coil.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

Figure 1:
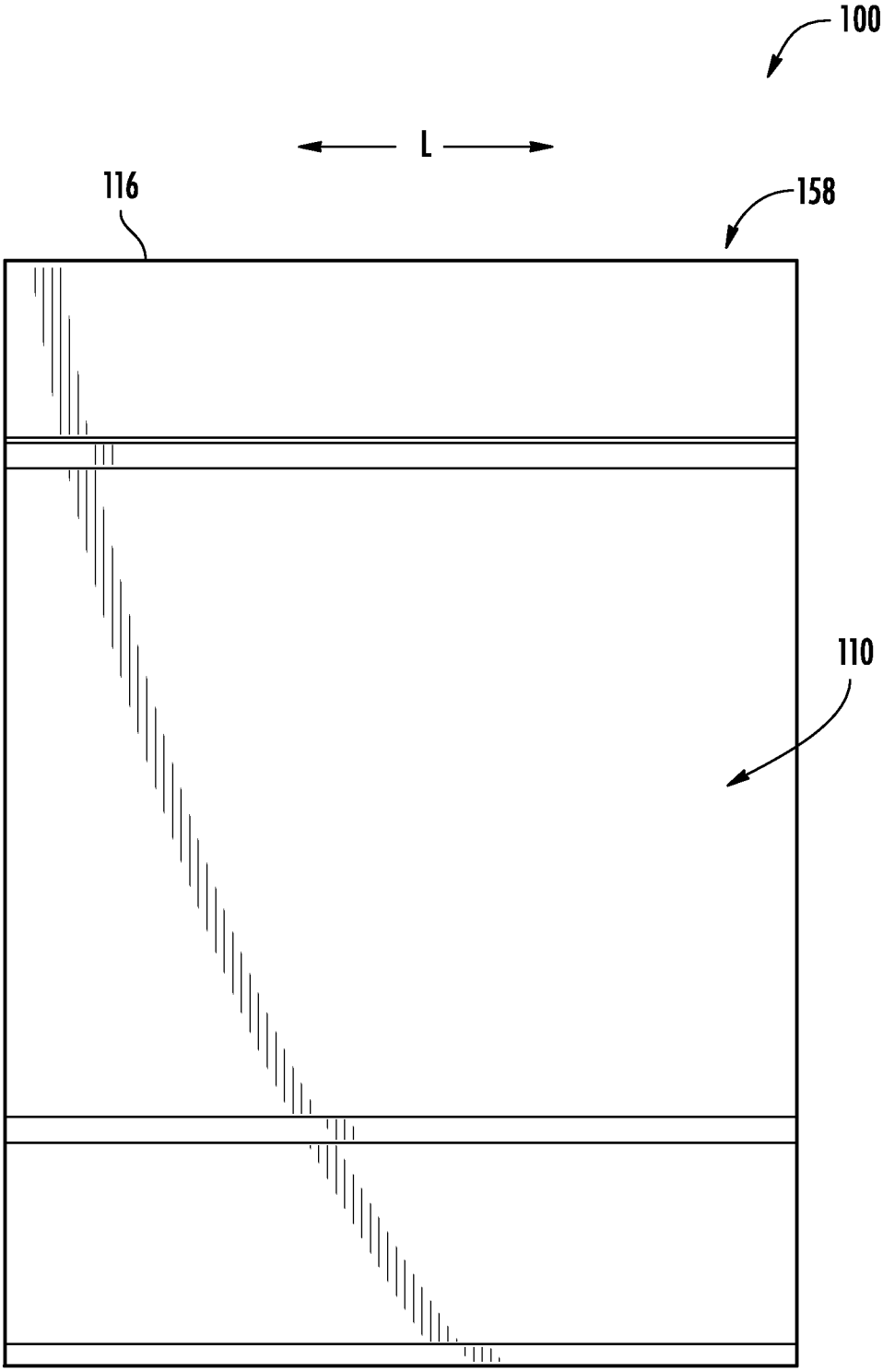
FIG. 1 provides a front view of a dishwashing appliance as an example embodiment of the present disclosure.

Repeat use of reference characters in the present specification and drawings is intended to represent the same or analogous features or elements of the present invention.

DETAILED DESCRIPTION OF THE INVENTION

Reference now will be made in detail to embodiments of the present disclosure, one or more examples of which are illustrated in the drawings. Each example is provided by way of explanation, not limitation of the disclosure. In fact, it will be apparent to those skilled in the art that various modifications and variations can be made in the present invention without departing from the scope or spirit of the disclosure. For instance, features illustrated or described as part of one embodiment can be used with another embodiment to yield a still further embodiment. Thus, it is intended that the present invention covers such modifications and variations as come within the scope of the appended claims and their equivalents.

As used herein, the terms "first," "second," and "third" may be used interchangeably to distinguish one component from another and are not intended to signify location or importance of the individual components. The terms "upstream" and "downstream" refer to the relative flow direction with respect to fluid flow in a fluid pathway. For example, "upstream" refers to the flow direction from which the fluid flows, and "downstream" refers to the flow direction to which the fluid flows. The terms "includes" and "including" are intended to be inclusive in a manner similar to the term "comprising." Similarly, the term "or" is generally intended to be inclusive (i.e., "A or B" is intended to mean "A or B or both").

Approximating language, as used herein throughout the specification and claims, is applied to modify any quantitative representation that could permissibly vary without resulting in a change in the basic function to which it is related. Accordingly, a value modified by a term or terms, such as "about," "approximately," and "substantially," are not to be limited to the precise value specified. In at least some instances, the approximating language may correspond to the precision of an instrument for measuring the value. For example, the approximating language may refer to being within a ten percent (10%) margin.

As used herein, the term "article" may refer to, but need not be limited to, dishes, pots, pans, silverware, and other cooking utensils and items that can be cleaned in a dishwashing appliance. The term "wash cycle" is intended to refer to one or more periods of time during the cleaning process where a dishwashing appliance operates while containing articles to be washed and uses a detergent and water, preferably with agitation, to e.g., remove soil particles including food and other undesirable elements from the articles. The term "rinse cycle" is intended to refer to one or more periods of time during the cleaning process in which the dishwashing appliance operates to remove residual soil, detergents, and other undesirable elements that were retained by the articles after completion of the wash cycle. The term "drying cycle" is intended to refer to one or more periods of time in which the dishwashing appliance is operated to dry the articles by removing fluids from the wash chamber. The term "fluid" refers to a liquid used for washing and/or rinsing the articles and is typically made up of water that may include additives such as e.g., detergent or other treatments. The use of the terms "top" and "bottom," or "upper" and "lower" herein are used for reference only as example embodiments disclosed herein are not limited to the vertical orientation shown nor to any particular configuration shown; other constructions and orientations may also be used.

Figure 2:
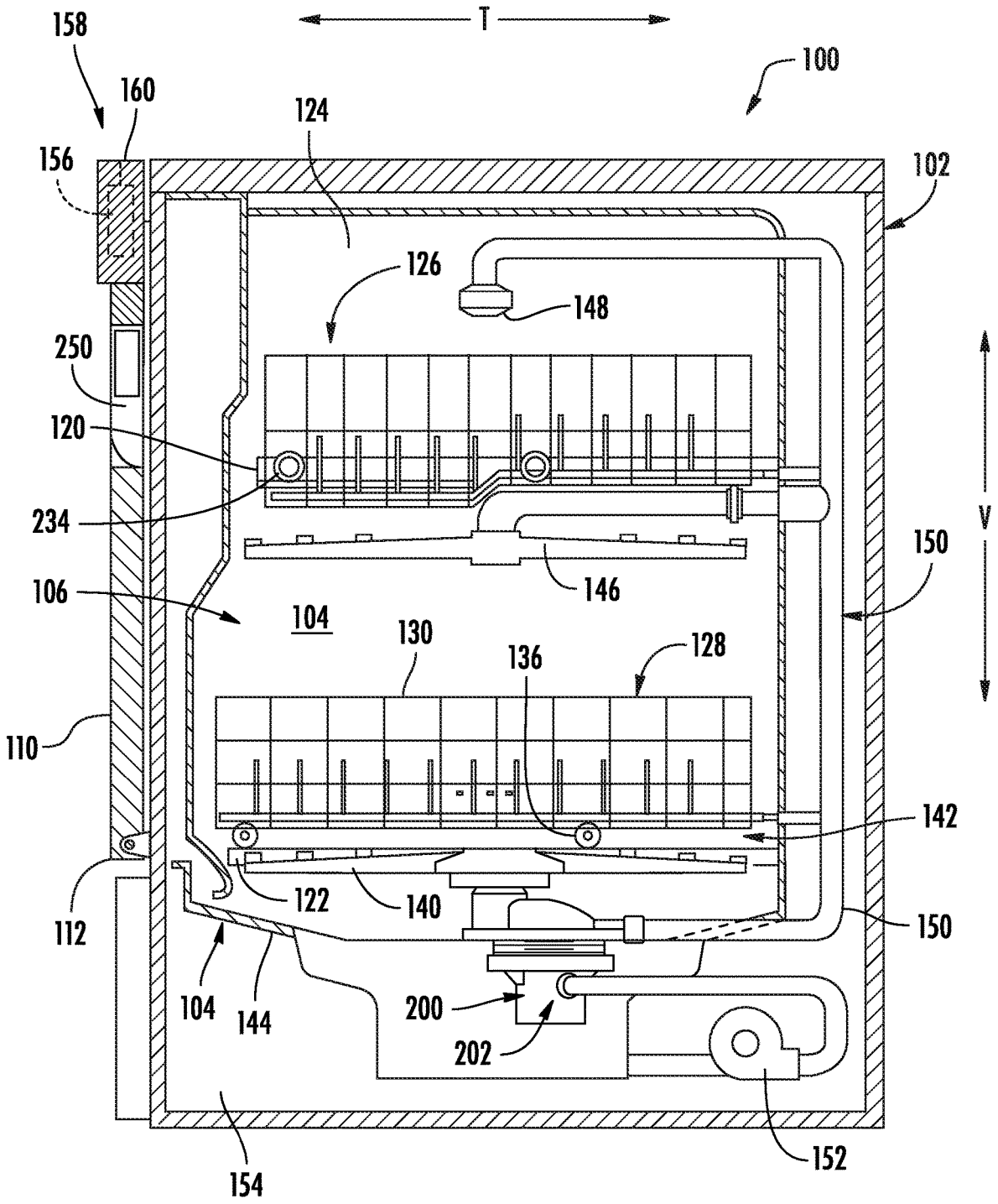
FIG. 2 provides a side cross sectional view of the example dishwashing appliance of FIG. 1.

FIGS. 1 and 2 depict an example appliance 100 is a dishwasher appliance that may be configured in accordance with aspects of the present disclosure. It should be appreciated that the invention is not limited to any particular style, model, or configuration of appliance 100. The example embodiment depicted in FIGS. 1 and 2 is for illustrative purposes only, as appliance 100 may be a dishwasher, washing machine, or any other suitable appliance utilizing detergent pods.

For the shown example embodiment of FIGS. 1 and 2, appliance 100 includes a cabinet 102 having a tub 104 therein that defines a wash chamber 106. The tub 104 includes a front opening (not shown) and a door 110 hinged at its bottom 112 for movement between a normally closed vertical position (shown in FIGS. 1 and 2), wherein the wash chamber 106 may be sealed shut for washing operation, and a horizontal open position for loading and unloading of articles from appliance 100. Latch 116 may be used to lock and unlock door 110 for access to wash chamber 106.

Upper and lower guide rails 120, 122 may mount on tub side walls 124 and accommodate roller-equipped rack assemblies 126 and 128. Each of the rack assemblies 126, 128 may be fabricated into lattice structures including a plurality of elongated members 130 (for clarity of illustration, not all elongated members making up rack assemblies 126 and 128 are shown in FIG. 2). Each rack 126, 128 is adapted for movement between an extended loading position (not shown) in which the rack is substantially positioned outside the wash chamber 106, and a retracted position (shown in FIGS. 1 and 2) in which the rack is located inside the wash chamber 106. The movement of each rack 126 and 128 may be facilitated by rollers 134 and 136, for example, mounted onto racks 126 and 128, respectively. A silverware basket (not shown) may be removably attached to rack assembly 128 for placement of silverware, utensils, and the like, that are otherwise too small to be accommodated by the racks 126, 128.

The appliance 100 further includes a lower spray-arm assembly 140 that is rotatably mounted within a lower region 142 of the wash chamber 106 and above a sump 144 so as to rotate in relatively close proximity to rack assembly 128. A mid-level spray-arm assembly 146 is located in an upper region of the wash chamber 106 and may be located in close proximity to upper rack 126. Additionally, an upper spray assembly 148 may be located above the upper rack 126.

The lower and mid-level spray-arm assemblies 140, 146 and the upper spray assembly 148 are part of a fluid circulation assembly 150 for circulating water and dishwasher fluid in the tub 104. The fluid circulation assembly 150 also includes a pump 152 positioned in a machinery compartment 154 located below the sump 144 (i.e., bottom wall) of the tub 104, as generally recognized in the art. Pump 152 receives fluid from sump 144 and provides a flow to the inlet 202 of a diverter, such as diverter 200, as more fully described below.

Each spray-arm assembly 140, 146 may include an arrangement of discharge ports or orifices for directing washing liquid received from diverter 200 onto dishes or other articles located in rack assemblies 126 and 128. The arrangement of the discharge ports in spray-arm assemblies 140, 146 provides a rotational force by virtue of washing fluid flowing through the discharge ports. The resultant rotation of spray-arm assemblies 140, 146 and the operation of spray assembly 148 using fluid from diverter 200 provides coverage of dishes and other dishwasher contents with a washing spray. Other configurations of spray assemblies may be used as well. For example, appliance 100 may have additional spray assemblies for cleaning silverware, for scouring casserole dishes, for spraying pots and pans, for cleaning bottles, etc. One skilled in the art will appreciate that the embodiments discussed herein are used for the purpose of explanation only, and are not limitations of the present subject matter.

Each spray assembly may receive an independent stream of fluid, may be stationary, and/or may be configured to rotate in one or both directions. For example, a single spray arm may have multiple sets of discharge ports, each set receiving wash fluid from a different fluid conduit, and each set being configured to spray in opposite directions and impart opposite rotational forces on the spray arm. In order to avoid stalling the rotation of such a spray arm, wash fluid is typically only supplied to one of the sets of discharge ports at a time.

Appliance 100 is further equipped with a controller 156 to regulate operation of the appliance 100. Controller 156 may include one or more memory devices and one or more microprocessors, such as general or special purpose microprocessors operable to execute programming instructions or micro-control code associated with a cleaning cycle. The memory may represent random access memory such as DRAM, or read only memory such as ROM or FLASH. In one embodiment, the processor executes programming instructions stored in memory. The memory may be a separate component from the processor or may be included onboard within the processor.

Controller 156 may be positioned in a variety of locations throughout appliance 100. In the illustrated embodiment, controller 156 may be located within a control panel area 158 of door 110 as shown in FIGS. 1 and 2. In such an embodiment, input/output ("I/O") signals may be routed between the control system and various operational components of appliance 100 along wiring harnesses that may be routed through the bottom 112 of door 110. Typically, controller 156 includes a user interface panel/controls 160 through which a user may select various operational features and modes and monitor progress of the appliance 100. In one embodiment, user interface 160 may represent a general purpose I/O ("GPIO") device or functional block. In one embodiment, user interface 160 may include input components, such as one or more of a variety of electrical, mechanical or electro-mechanical input devices including rotary dials, push buttons, and touch pads. User interface 160 may include a display component, such as a digital or analog display device designed to provide operational feedback to a user. User interface 160 may be in communication with controller 156 via one or more signal lines or shared communication busses. It should be appreciated that the invention is not limited to any particular style, model, or configuration of appliance 100. The example embodiment depicted in FIGS. 1 and 2 is for illustrative purposes only. For example, different locations may be provided for user interface 160, different configurations may be provided for racks 126, 128, different spray arm assemblies 140, 146, 148 may be used, and other differences may be applied as well.

Figure 3:
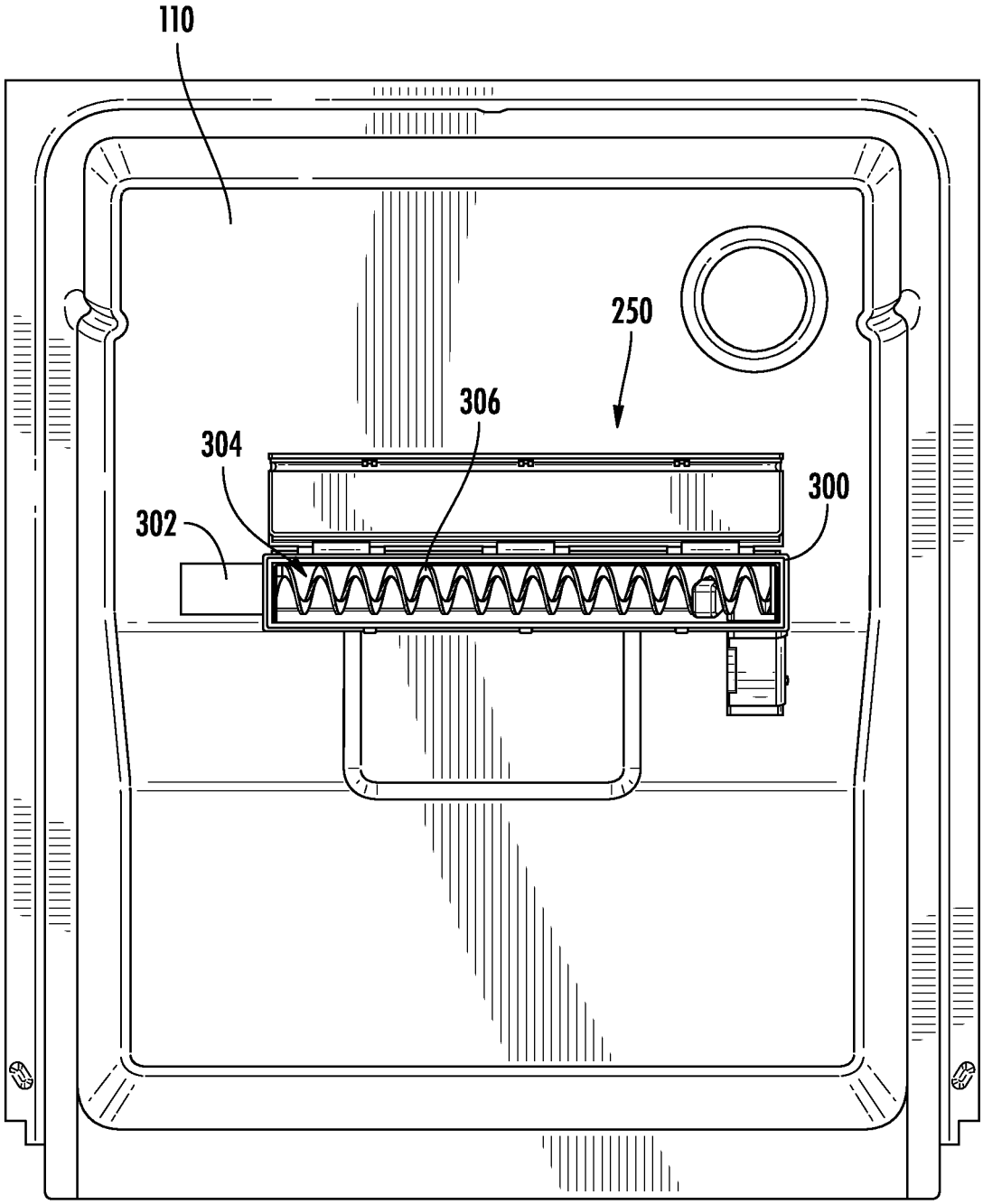
FIG. 3 provides a rear view of the door of the dishwashing appliance of FIG. 1.

As may be seen in FIGS. 2 and 3, appliance 100 also includes a dispenser apparatus, or dispensing assembly 250. Dispenser apparatus 250 may be used to dispense detergent pods into wash chamber 106. Controller 156 may communicate with dispenser apparatus 250 in order regulate ejection of a detergent pod from dispenser apparatus 250 during the wash cycle. In certain example embodiments, dispenser apparatus 250 may be positioned on the interior of door 110 as shown. Such positioning of dispenser apparatus 250 may advantageously facilitate user access to dispenser apparatus, e.g., for reloading. However, it will be understood that dispenser apparatus 250 may be mounted on other components of dishwasher appliance 100, such as tub 104, in alternative example embodiments.

Dispensing apparatus 250 has a housing 300 that defines a loading chamber 304. Housing 300 may be constructed from plastic or metal. A motor 302 may be coupled to housing 300 at loading chamber 304. Motor 302 may be operable to rotate an auger or corkscrew coil 306 disposed within loading chamber 304. Corkscrew coil 306 may be configured to act as a conveyer for detergent pods placed in the fighting of corkscrew coil 306. Motor 302 may be a servo motor, stepper motor, or other motor of the like.

Figure 4:
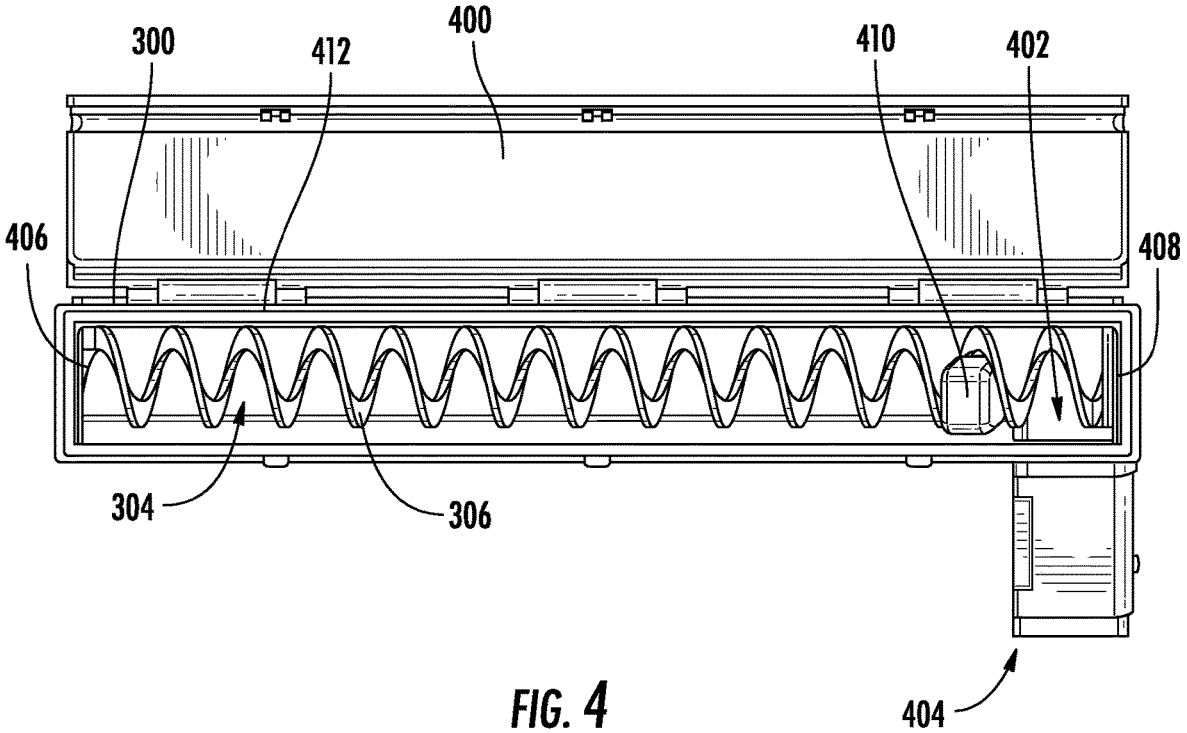
FIG. 4 provides a front plan view of a dispenser apparatus of FIG. 3.

FIG. 4 depicts an example embodiment of dispenser apparatus 250. A door 400 may be hingedly connected to housing 300 of dispenser apparatus 250. Door 400 may include a gasket such that when door 400 is closed, housing 300 is sealed from the wash chamber 106. Door 400 may be opened in order to load detergent pods into loading chamber 304. Loading chamber 304 may be sized to hold at least six and no more than twenty detergent pods, in certain example embodiments. For instance, loading chamber 304 may be elongated along the lateral direction L such that a stack of detergent pods may be loaded into loading chamber 304. Thus, the detergent pods may be stacked or distributed along the lateral direction L within loading chamber 304 between the fighting of corkscrew coil 306. Having multiple detergent pods stored in the housing may advantageously prevent a user from having to manually replace the detergent pod after each complete wash cycle of dishwasher appliance 100.

Corkscrew coil 306 may be sized to facilitate receipt of the detergent pods. For example, a length of the corkscrew coil 306, e.g., along the lateral direction L, may be no less than fifteen centimeters (15 cm) and no greater than sixty centimeters (60 cm). As another example, a width of corkscrew coil 306, e.g., perpendicular to the width, may be no less than two centimeters (2 cm) and no greater than ten centimeters (10 cm). A pitch of the corkscrew coil 306 may be no less than one centimeter (1 cm) and no greater than five centimeters (5 cm). Corkscrew coil 306 may also include no less than six windings or rotations and no more than thirty windings or rotations, in certain example embodiments.

The detergent pods, including pod 410, may be moved though loading chamber 304 by the rotation of corkscrew coil 306. Corkscrew coil 306 has two end portions, referred to as a first end portion 406 and a second end portion 408. In the present example embodiment, motor 302 is coupled to first end portion 406, and second end portion 408 is rotatably coupled to housing 300. In other example embodiments, motor 302 may be coupled to second end portion 408, and first end portion 406 may be rotatably coupled to the housing 300. Door 400 may close and locked to housing 300. Thus, e.g., loading chamber 304 and detergent pods therein may be sealed relative to wash chamber 106. Moreover, housing 300 and door 400 may block water, steam, and other fluids from wash chamber 106 from flowing into loading chamber 304 and partially dissolving the detergent pods, e.g., an outer film of the detergent pods. When pod 410 reaches opening 402, the pod may be ejected out of chute 404 by gravity. Chute 404 may be positioned such that a detergent pod may travel directly into wash chamber 106. In certain example embodiments, chute 404 may be omitted from dispenser apparatus 250, such that the detergent pods may be deposited directly into wash chamber 106 from loading chamber 304. In other example embodiments, chute 404 may be replaced by another suitable device configured to guide the detergent pods dispensed from dispenser apparatus 250 into wash chamber 106.

As may be seen from the above, dispenser apparatus 250 delivers detergent pods individually into wash chamber 106 for the wash cycle of appliance 100. Housing 300 defines loading chamber 304 which is where the detergent pods are held. Loading chamber 304 includes a corkscrew coil 306 where the detergent pods, such as pod 410, are inserted between the fighting of corkscrew coil 306 to keep the detergent pods separated for individual dispensing. Door 400 may be closed by a user, and door 400 closes on a gasket 412 to seal and separate loading chamber 304 from wash chamber 106. Motor 302, such as a servo motor, rotates corkscrew coil 306 to dispense one pod through opening 402, out chute 404, and into wash chamber 106.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A dispensing apparatus for an appliance, comprising:

a housing defining a loading chamber;

a corkscrew coil rotatably mounted in the loading chamber of the housing, the corkscrew coil configured for receipt of a plurality of detergent pods between flighting of the corkscrew coil; and a motor coupled to the corkscrew coil, whereby the motor is configured to rotate the corkscrew coil.

2. The dispensing apparatus as in claim 1, wherein the loading chamber is sized such that no less than six and no more than twenty detergent pods are receivable within the loading chamber.

3. The dispensing apparatus as in claim 1, further comprising a door rotatably mounted by a hinge to the housing such that closing the door seals the housing.

4. The dispensing apparatus as in claim 3, wherein the door comprises a gasket.

5. The dispensing apparatus as in claim 1, further comprising a chute defining an opening at an end of the corkscrew coil.

6. The dispensing apparatus as in claim 1, wherein the housing is a plastic housing.

7. A detergent pod dispensing apparatus for an appliance, comprising:

a housing defining a loading chamber;

a door rotatably coupled to the housing, the door comprising a gasket;

a corkscrew coil disposed within the loading chamber, the corkscrew coil comprising a first end portion and a second end portion, the corkscrew coil rotatably mounted to the housing at the second end portion; and a motor coupled to the corkscrew coil, the motor coupled to the corkscrew coil at the first end portion, whereby the motor is configured to rotate the corkscrew coil;

wherein the corkscrew coil is configured for receipt of a plurality of detergent pods between fighting of the corkscrew coil.

8. The dispensing apparatus as in claim 7, wherein the loading chamber is sized such that no less than six and no more than twenty detergent pods are receivable within the loading chamber.

9. The dispensing apparatus as in claim 7, wherein the door is rotatably mounted by a hinge to the housing such that closing the door seals the housing.

10. The dispensing apparatus as in claim 7, further comprising a chute defining an opening at the second end portion of the corkscrew coil.

11. The dispensing apparatus as in claim 7, wherein the housing is a plastic housing.

12. The dispensing apparatus as in claim 7, wherein the corkscrew coil is rotatably mounted to the housing at the first end portion and the motor is coupled to the corkscrew coil at the second end portion.

13. An appliance, comprising:

a cabinet defining a wash chamber; and a detergent pod dispensing assembly, comprising, a housing defining a loading chamber, a door rotatably coupled to the housing, the door comprising a gasket, a corkscrew coil disposed within the loading chamber, the corkscrew coil comprising a first end portion and a second end portion, the corkscrew coil coiled around a constant radius between the first end portion and the second end portion, and a motor coupled to the corkscrew coil, wherein the corkscrew coil is configured for receipt of a plurality of detergent pods between fighting of the corkscrew coil.

14. The dispensing assembly as in claim 13, wherein the loading chamber is sized such that no less than six and no more than twenty detergent pods are receivable within the loading chamber.

15. The dispensing assembly as in claim 13, wherein the door is rotatably mounted by a hinge to the housing such that closing the door seals the housing at the wash chamber.

16. The dispensing assembly as in claim 13, further comprising a chute defining an opening at the second end portion of the corkscrew coil.

17. The dispensing assembly as in claim 16, wherein the chute is positioned at the wash chamber of the appliance.

18. The dispensing assembly as in claim 13, wherein the housing is a plastic housing.

* * * * *